US006561630B2

(12) United States Patent
Holstun

(10) Patent No.: US 6,561,630 B2
(45) **Date of Patent: *May 13, 2003**

(54) BARRIER ADHESION BY PATTERNING GOLD

(75) Inventor: Clayton L. Holstun, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/121,402

(22) Filed: Apr. 12, 2002

(65) Prior Publication Data

US 2002/0180838 A1 Dec. 5, 2002

Related U.S. Application Data

(63) Continuation of application No. 09/875,373, filed on Jun. 5, 2001, now Pat. No. 6,386,687.

(51) Int. Cl.[7] ..... B41J 2/05

(52) U.S. Cl. ..... 347/63

(58) Field of Search ..... 347/50, 63, 64, 347/65, 67, 58, 59, 56; 438/21, 42, 43, 106, 108, 121

(56) References Cited

U.S. PATENT DOCUMENTS 4,719,477 A * 1/1988 Hess ..... 347/59
5,317,346 A * 5/1994 Garcia ..... 347/63

* cited by examiner

*Primary Examiner*—Craig Hallacher
*Assistant Examiner*—Juanita Stephens

(57) ABSTRACT

An ink jet printhead including a thin film substructure including an elongated gold trace having openings formed therein. An ink barrier layer is disposed on the thin film substructure in contact with the gold trace and the regions exposed by the openings in the elongated gold trace. The openings are configured to provide for reliable adhesion between the ink barrier layer and the regions exposed by the openings in the elongated gold trace.

20 Claims, 4 Drawing Sheets

BARRIER ADHESION BY PATTERNING GOLD

CROSS REFERENCE TO RELATED APPLICATION(S)

This is a continuation of application Ser. No. 09/875,373 filed on Jun. 5, 2001, now U.S. Pat. No. 6,386,687.

BACKGROUND OF THE INVENTION

The subject invention generally relates to ink jet printing, and more particularly to thin film ink jet printheads for ink jet cartridges and methods for manufacturing such printheads.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent to the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The thin film substructure more particularly includes a top thin film layer of tantalum disposed over the resistors as a thermomechanical passivation layer.

The ink barrier layer is typically a polymer material that is laminated as a dry film to the thin film substructure, and is designed to be photodefinable and both UV and thermally curable.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,417,346, both of which are incorporated herein by reference.

A consideration with the foregoing ink jet printhead architecture includes delamination of the ink barrier layer from the thin film substructure. Delamination principally occurs from environmental moisture and the ink itself which is in continual contact with the edges of the thin film substructure/barrier interface in the drop generator regions.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
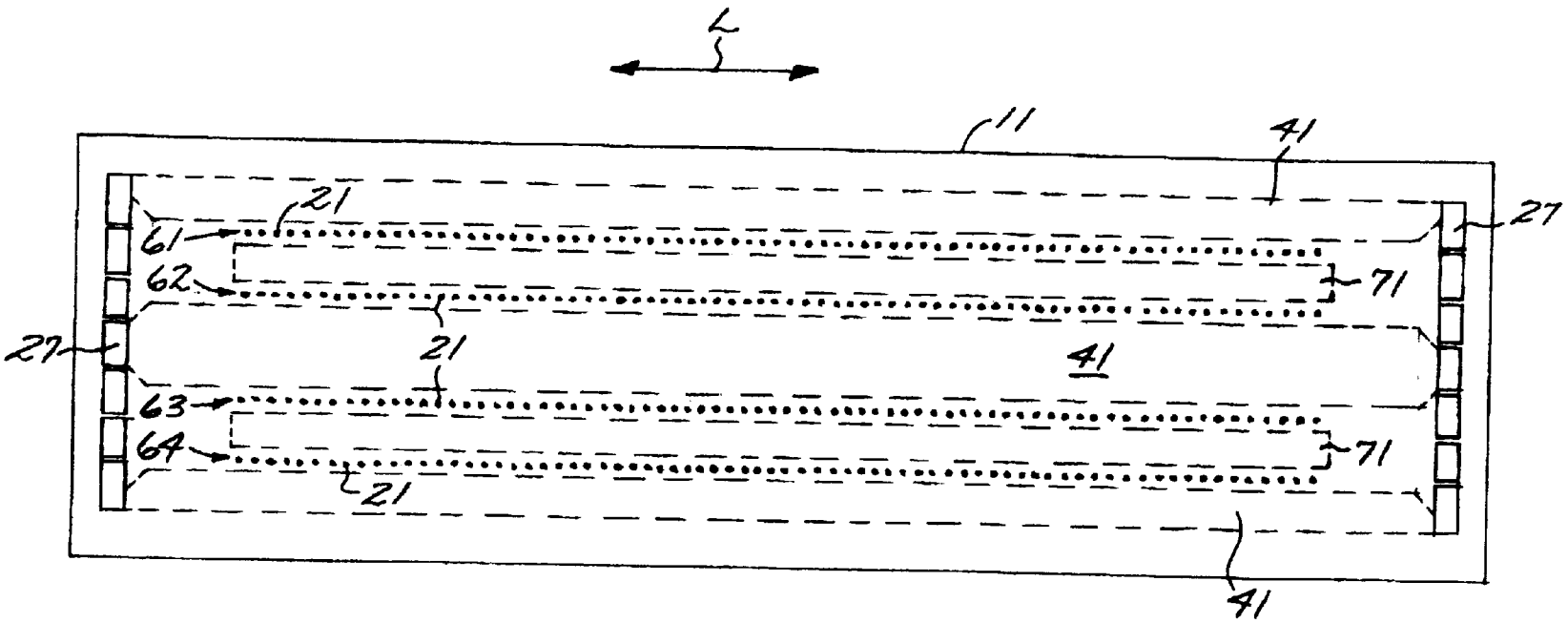
FIG. 1 is a schematic top plan view of an embodiment of an ink jet printhead that employs the invention.

In the following detailed description and in the several figures of the drawing, like elements are identified with like reference numerals.

Figure 2:
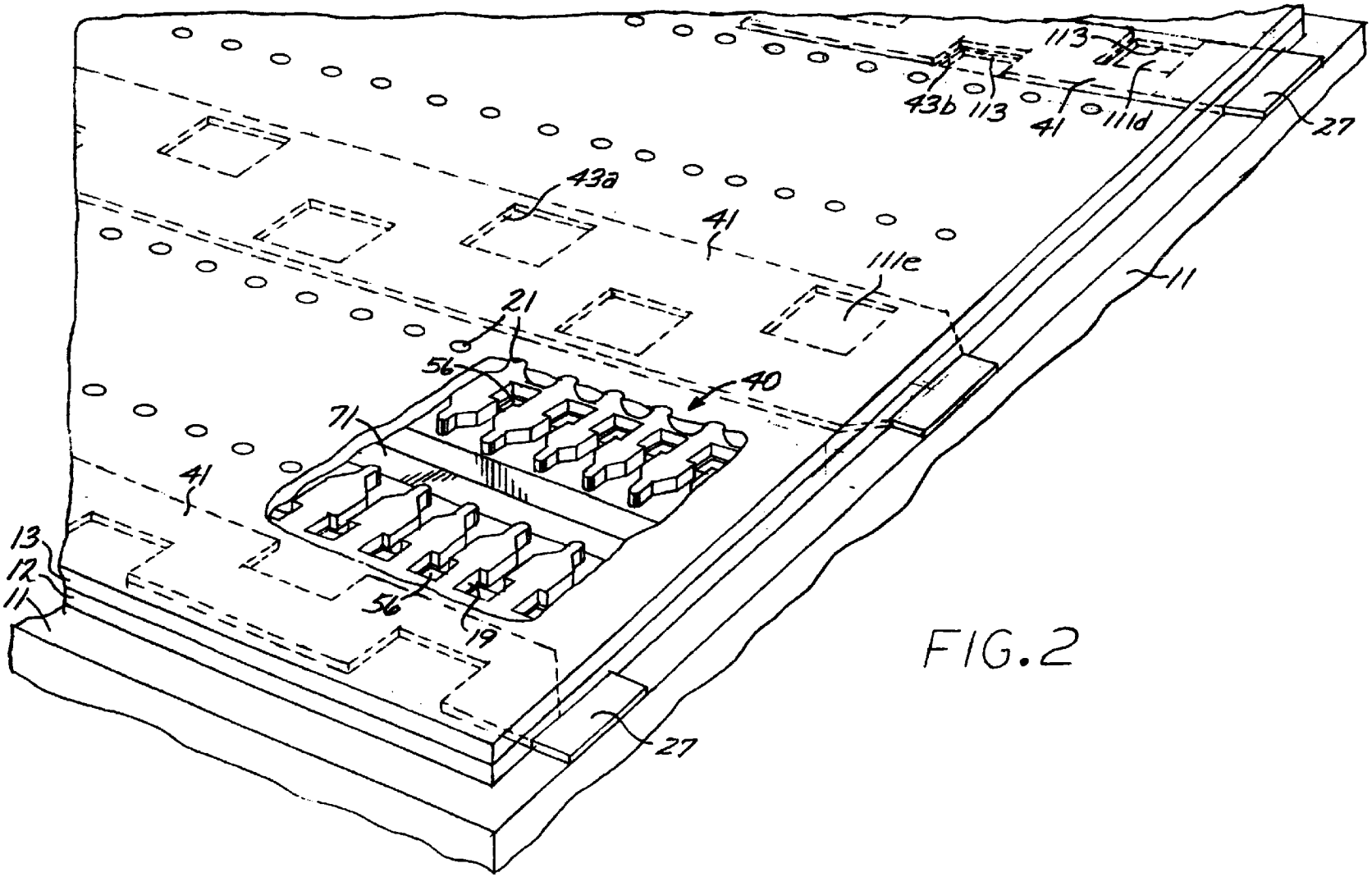
FIG. 2 a schematic, partially sectioned perspective view of the ink jet printhead of FIG. 1.

Referring now to FIGS. 1 and 2, set forth therein are an unscaled schematic plan view and an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12.

The thin film substructure 11 is formed pursuant to integrated circuit fabrication techniques, and includes thin film heater resistors 56 formed therein. By way of illustrative example, the thin film heater resistors 56 are arranged in columns along opposing ink feed edges of ink feed slots 71. The columns of heater resistors and the ink feed slots are aligned with a longitudinal axis L of the printhead.

The ink barrier layer 12 is formed of a dry film that is heat and pressure laminated to the thin film substructure 11 and photodefined to form therein ink chambers 19 and ink channels 29. Gold bond pads 27 engagable for external electrical connections are disposed at the ends of the thin film substructure 11 and are not covered by the ink barrier layer 12. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56 formed in the thin film substructure 11, and each ink chamber 19 is defined by the edge or wall of a chamber opening formed in the barrier layer 12. The ink channels 29 are defined by further openings formed in the barrier layer 12, and are integrally joined to respective ink firing chambers 19. The orifice plate 13 includes orifices 21 disposed over respective ink chambers 19, such that an ink firing resistor 56, an associated ink chamber 19, and an associated orifice 21 form an ink drop generator 40.

The ink drop generators are thus arranged in columns 61, 62, 63, 64 aligned with the longitudinal axis L of the printhead and located on opposing ink feed sides or edges of ink feed slots 71. The columns 61, 64 are adjacent longitudinal edges of the thin film substructure 11 and comprise outboard columns of ink drop generators, while the columns 62, 63 are between the outboard columns and comprise inboard columns of ink drop generators.

While the disclosed printhead is described as having a barrier layer and a separate orifice plate, it should be appreciated that the printhead can be implemented with an integral barrier/orifice structure that can be made, for example, using a single photopolymer layer that is exposed with a multiple exposure process and then developed.

Figure 3:
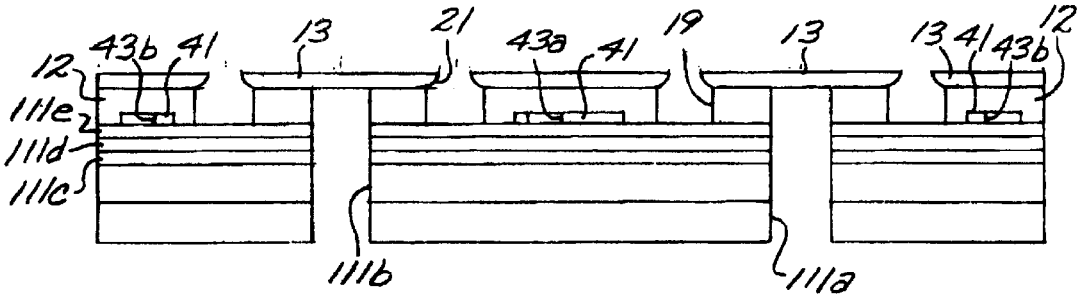
FIG. 3 is a schematic cross-sectional view of the ink jet printhead of FIG. 1 depicting layers of the printhead.
Figure 4:
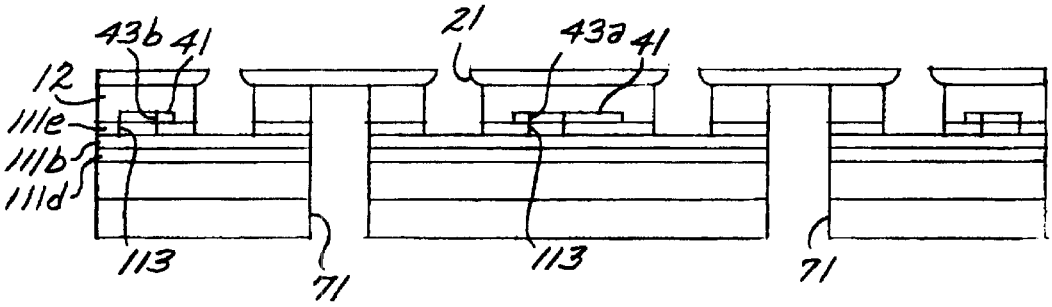
FIG. 4 is a schematic cross-sectional view of the ink jet printhead of FIG. 1 depicting openings in a layer that underlies gold traces of the printhead.

Referring now to FIG. 3, set forth therein is a schematic depiction of layers of the thin film substructure 11 which comprises a silicon substrate 111*a*, a device stack 111*b* in which actives devices (such as FET circuits) and heater resistors are formed, and a composite passivation layer 111*c* comprising for example a silicon nitride layer and a silicon carbide layer. A patterned silicon dioxide layer 11*d* is disposed on the composite passivation layer 111*c*, and a patterned tantalum mechanical passivation layer 111*e* is disposed on the silicon dioxide layer 111*d*. A patterned gold layer comprised of a plurality of elongated gold conductive traces 41 in accordance with the invention is disposed on the tantalum layer 111*e*.

The ink barrier layer 12 is laminarly attached to the top of the thin film substructure 11 and is in contact with the elongated gold traces 41 portions of the tantalum layer 111*e*, and portions of the silicon dioxide layer 11*d*, depending on the patterning of such layers.

As depicted in FIG. 1, the elongated gold traces 41 extend along the longitudinal extent L of the printhead, and can comprise for example power traces that provide ink firing energy to drive circuits that switchably energize the heater resistors. By way of illustrative example, an outboard elongated gold trace 41 is located between a longitudinal edge of the thin film substructure 11 and the outboard column 61 of ink drop generators, while a generally centrally located elongated gold trace 41 is located between the inboard columns 62, 63 of ink drop generators. Another outboard elongated gold trace 41 can be located between the other longitudinal edge of the thin film substructure 11 and the outboard column 64 of ink drop generators. By way of specific example, the centrally located elongated gold trace 41 can be wider than the outboard elongated gold traces 41.

As schematically depicted in FIGS. 5–8, the elongated gold trace 41 is more particularly patterned with openings 43*a*, 43*b*, 43*c* to enhance adhesion of the barrier layer 12 to the thin film substructure 11. The opening can be an enclosed opening 43*a* (FIGS. 5 and 7) wherein the opening is contained within the gold trace such that the entire boundary of the opening is gold. The opening can be an indented opening 43*b* (FIGS. 5–7) that is outside the perimeter of the gold trace and is like an indentation, cut-out or notch at the edge of a gold trace. Indented openings effectively provide for gold traces having non-linear edges. The opening can also be a gap opening 43*c* (FIG. 8) that extends the lateral extent of the gold trace which with the gaps effectively is comprised of a series of gold segments. Thus, a gap opening includes two separate non-gold boundary sections that create a structural discontinuity in the gold trace, while enclosed and indented openings do not create a structural discontinuity in the gold trace.

By way of illustrative example, the elongated gold trace and the openings therein can occupy a generally rectangular area.

The openings 43*a*, 43*b*, 43*c* are sufficiently large such that the ink barrier layer reliably adheres to the region of a layer that underlies an opening in the gold trace and is exposed by the opening 12. By way of illustrative example, the areas of the openings can be at least 400 microns$^2$. The area of an indented opening can be considered as the area of gold that is removed from a gold trace having a linear edge to make the indentation. The area of a gap opening can be considered as the area of gold that is removed between opposing sides or edges to form the gap.

The region exposed by an enclosed opening 43*a* or an indented opening 43*b* in a gold trace can comprise a region of the tantalum layer 111*e* or a region of the silicon dioxide layer 111*d*. In the latter case, an opening 113 is formed in the tantalum layer 111*e* beneath the opening in the gold trace, as schematically depicted in FIGS. 2 and 4–6. The openings 113 in the tantalum layer 111*e* can be coextensive with the corresponding openings 43 in the gold trace 41, or they can be larger, for example extending beyond the lateral boundaries of the gold trace. The region exposed by a gap opening 43*c* preferably comprises a region of the tantalum layer 111*e* so as to provide for electrical continuity along the longitudinal extent of the gold trace.

Figure 8:
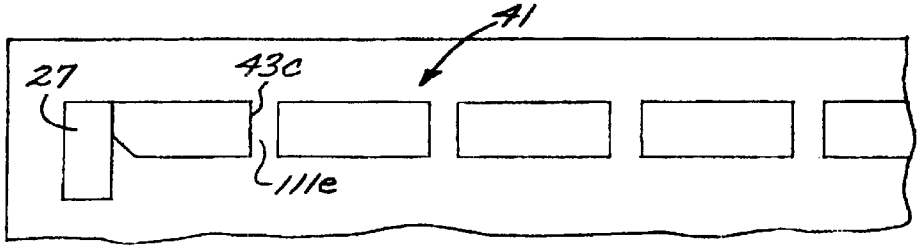
FIG. 8 is a partial plan view illustrating another example of a gold trace in accordance with the invention.
Figure 5:
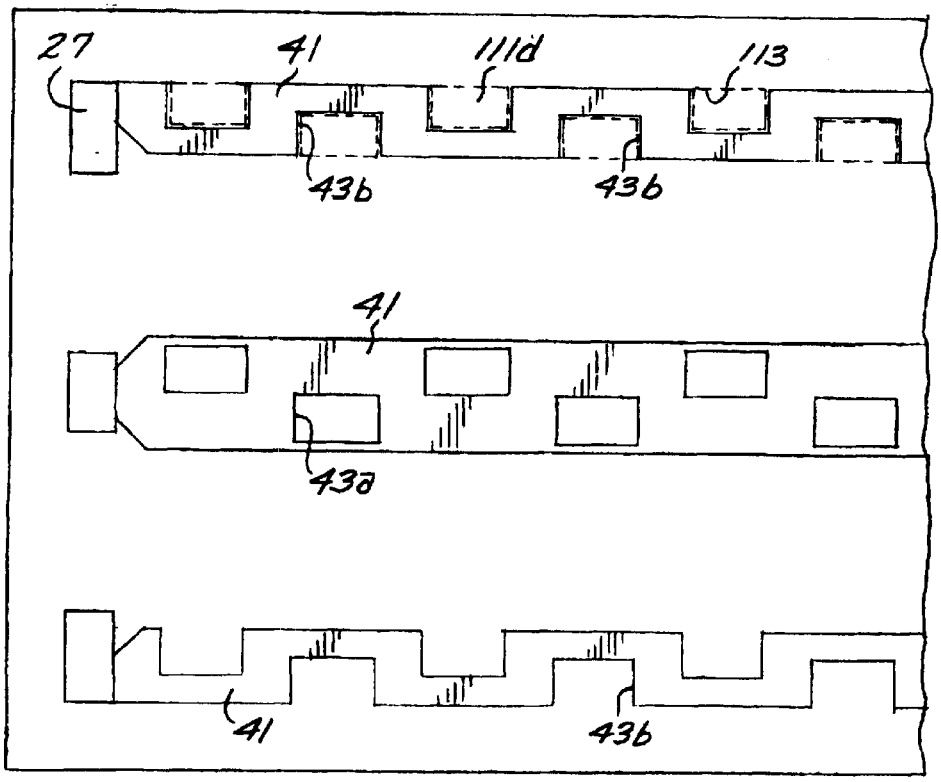
FIG. 5 is a partial plan view of the printhead of FIG. 1 illustrating examples of gold traces in accordance with the invention.
Figure 6:
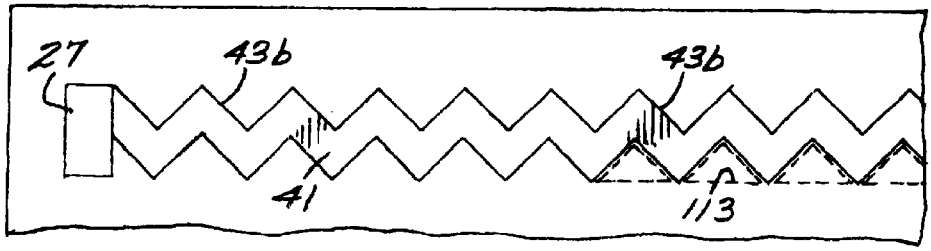
FIG. 6 is a partial plan view illustrating a further example of a gold trace in accordance with the invention.
Figure 7:
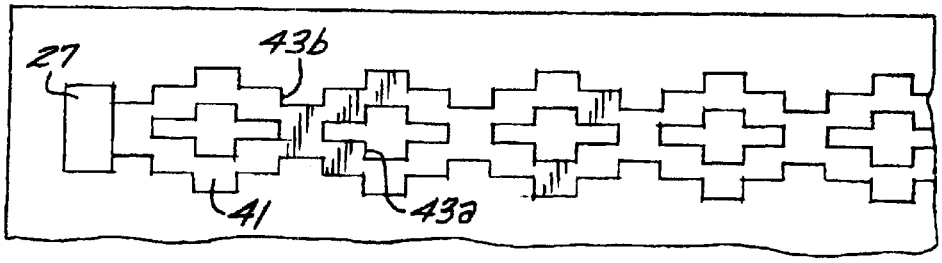
FIG. 7 is a partial plan view illustrating another example of a gold trace in accordance with the invention.

An opening in a gold trace can include linear sides, and can more particularly comprise a polygon. FIG. 5 schematically depicts rectangular enclosed and indented openings. FIG. 6 schematically depicts a gold trace having triangularly shaped indented openings 43, such that the elongated gold trace has a zig-zag pattern. FIG. 7 schematically depicts a gold trace having a cross-shaped enclosed openings 43*a*, and stepped indented openings 43*c*. FIG. 8 schematically depicts a gold trace having rectangular gap openings 43*c*.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid drop emitting structure comprising:

a thin film substructure including an elongated patterned gold trace disposed on a top portion thereof and having a plurality of heater resistors formed therein;

a plurality of openings formed in said elongated gold trace such that regions of said thin film substructure underlying said openings are exposed;

a fluid barrier layer disposed on said think film substrate and in contact with said elongated gold trace and said exposed regions; and said openings in said elongated gold trace configured to provide reliable adhesion between said fluid barrier layer and said exposed regions.

2. The fluid drop emitting structure of claim 1 wherein said openings comprise enclosed openings.

3. The fluid drop emitting structure of claim 1 wherein said openings comprise indented openings.

4. The fluid drop emitting structure of claim 1 wherein said openings comprise gaps in said gold trace, and wherein said regions exposed by said gaps comprise a conductive material.

5. The fluid drop emitting structure of claim 1 wherein said openings include linear sides.

6. The fluid drop emitting structure of claim 1 wherein said openings comprise polygons.

7. The fluid drop emitting structure of claim 1 wherein each of said openings has an area of at least 400 micrometers$^2$.

8. The fluid drop emitting structure of claim 1 wherein said gold trace and said openings occupy an elongated, generally rectangular region.

9. The fluid drop emitting structure of claim 1 wherein said exposed regions comprise tantalum.

10. The fluid drop emitting structure of claim 1 wherein said exposed regions comprise silicon dioxide.

11. A fluid controlling structure comprising:

a thin film substructure including an elongated patterned gold trace disposed on a top portion thereof;

a plurality of openings formed in said elongated gold trace such that regions of said thin film substructure underlying said openings are exposed;

a fluid barrier layer disposed on said thin film substructure and in contact with said elongated gold trace and said exposed regions; and said openings in said elongated gold trace configured to provide reliable adhesion between said fluid barrier layer and said exposed regions.

12. The fluid controlling structure of claim 11 wherein said openings comprise enclosed openings.

13. The fluid controlling structure of claim 11 wherein said openings comprise indented openings.

14. The fluid controlling structure of claim 11 wherein said openings comprise gaps in said gold trace.

15. The fluid controlling structure of claim 11 wherein said openings include linear sides.

16. The fluid controlling structure of claim 11 wherein said openings comprise polygons.

17. The fluid controlling structure of claim 11 wherein each of said openings has an area of at least 400 micrometers$^2$.

18. The fluid controlling structure of claim 11 wherein said gold trace and said openings occupy an elongated, generally rectangular region.

19. The fluid controlling structure of claim 11 wherein said exposed regions comprise tantalum.

20. The fluid controlling structure of claim 11 wherein said exposed regions comprise silicon dioxide.

* * * * *